US008031134B2

(12) United States Patent
Ogawa et al.

(10) Patent No.: US 8,031,134 B2
(45) Date of Patent: Oct. 4, 2011

(54) METHOD OF DRIVING PLASMA DISPLAY PANEL

(75) Inventors: Kenji Ogawa, Osaka (JP); Shigeo Kigo, Osaka (JP); Minoru Takeda, Osaka (JP)

(73) Assignee: Panasonic Corporation, Osaka (JP)

( * ) Notice: Subject to any disclaimer, the term of this patent is extended or adjusted under 35 U.S.C. 154(b) by 193 days.

(21) Appl. No.: 10/566,327

(22) PCT Filed: May 13, 2005

(86) PCT No.: PCT/JP2005/009199

§ 371 (c)(1),
(2), (4) Date: Jan. 27, 2006

(87) PCT Pub. No.: WO2005/111974

PCT Pub. Date: Nov. 24, 2005

(65) Prior Publication Data

US 2008/0048937 A1 Feb. 28, 2008

(30) Foreign Application Priority Data

May 14, 2004 (JP) ..... 2004-144501

(51) Int. Cl.
*G09G 3/28* (2006.01)

(52) U.S. Cl. ..... 345/60; 345/63; 315/169.4

(58) Field of Classification Search ..... 345/60–72; 315/169.4

See application file for complete search history.

(56) References Cited

U.S. PATENT DOCUMENTS

| | | | | |
|---|---|---|---|---|
| 6,140,775 | A * | 10/2000 | Hirakawa | 315/169.4 |
| 6,294,875 | B1 * | 9/2001 | Kurata et al. | 315/169.1 |
| 6,940,475 | B2 * | 9/2005 | Shiizaki et al. | 345/60 |
| 7,109,951 | B2 * | 9/2006 | Kim et al. | 345/63 |
| 7,218,292 | B2 * | 5/2007 | Kashio et al. | 345/60 |
| 7,446,734 | B2 * | 11/2008 | Kigo et al. | 345/60 |
| 2001/0020923 | A1 * | 9/2001 | Homma | 345/60 |
| 2002/0021264 | A1 * | 2/2002 | Nakamura | 345/60 |

FOREIGN PATENT DOCUMENTS

| | | | |
|---|---|---|---|
| JP | 2000-242224 | A | 9/2000 |
| JP | 2000-259123 | A | 9/2000 |
| JP | 2001-255847 | A | 9/2001 |

OTHER PUBLICATIONS

International Search Report for application No. PCT/JP2005/009199 dated Aug. 23, 2005.

* cited by examiner

*Primary Examiner* — Jason Mandeville
(74) *Attorney, Agent, or Firm* — Ratnerprestia

(57) ABSTRACT

In the initializing period of each of sub-fields comprising one field, one of all-cell initializing operation and selective initializing operation is performed. The all-cell initializing operation causes initializing discharge in all the discharge cells for displaying an image. The selective initializing operation selectively causes initializing discharge only in the discharge cells subjected to sustaining discharge in the preceding sub-field. Provided in the all-cell initializing period is an abnormal charge erasing part in which application of a rectangular waveform voltage to the scan electrodes causes self-erasing discharge in the discharge cells having excessive wall voltage accumulated therein.

3 Claims, 5 Drawing Sheets

METHOD OF DRIVING PLASMA DISPLAY PANEL

This Application is a U.S. National Phase Application of PCT International Application PCT/JP2005/009199.

TECHNICAL FIELD

The present invention relates to a method of driving a plasma display panel.

BACKGROUND ART

An alternating-current surface-discharging panel representing plasma display panels (hereinafter abbreviated as "panels") has a large number of discharge cells formed between a front panel and rear panel faced with each other. In the front panel, a plurality of display electrodes, each made of a pair of scan electrode and sustain electrode, are formed on a front glass substrate in parallel with each other. A dielectric layer and a protective layer are formed to cover these display electrodes. In the rear panel, a plurality of parallel data electrodes is formed on a rear glass substrate. A dielectric layer is formed on the data electrodes to cover them. Further, a plurality of barrier ribs is formed on the dielectric layer in parallel with the data electrodes. Phosphor layers are formed on the surface of the dielectric layer and the side faces of the barrier ribs. Then, the front panel and the rear panel are faced with each other and sealed together so that the display electrodes and data electrodes intersect with each other. A discharge gas is filled into an inside discharge space formed therebetween. Discharge cells are formed in portions where respective display electrodes are opposed to corresponding data electrodes. In a panel structured as above, ultraviolet light is generated by gas discharge in each discharge cell. This ultraviolet light excites respective phosphors of R, G, and B colors, to emit respective colors for color display.

A general method of driving a panel is a sub-field method: one field period is divided into a plurality of sub-fields and combination of light-emitting sub-fields provides gradation display. Among the sub-field method, a novel driving method of minimizing the light emission unrelated to gradation display to inhibit an increase in black picture level and improve a contrast ratio is disclosed in Japanese Patent Unexamined Publication No. 2000-242224.

The driving method is briefly described hereinafter. Each sub-field has an initializing period, writing period, and sustaining period. In the initializing period, one of all-cell initializing operation and selective initializing operation is performed. The all-cell initializing operation causes initializing discharge in all the discharge cells for image display. The selective discharge operation selectively causes initializing discharge in the discharge cells subjected to sustaining discharge in the preceding sub-filed.

First, in the all-cell initializing period, all the discharge cells perform initializing discharge operation at a time, to erase the history of wall electric charge previously formed in respective discharge cells and form wall electric charge necessary for the subsequent writing operation. Additionally, this initializing discharge operation serves to generate priming (priming for discharge=excited particles) for reducing discharge delay and causing stable writing discharge. In the subsequent writing period, scan pulses are sequentially applied to scan electrodes, and write pulses corresponding to the signals of an image to be displayed are applied to data electrodes. Thus, selective writing discharge is caused between the scan electrodes and corresponding data electrodes to selectively form wall electric charge. In the sustaining period, a predetermined number of sustain pulses according to a brightness weight is applied between the scan electrodes and corresponding sustain electrodes. Then, the discharge cells in which wall electric charge has been formed by the writing discharge are selectively discharged so that light is emitted from the discharge cells.

In this manner, to properly display an image, selective writing discharge must securely be performed in the writing period. For this purpose, ensuring initializing operation, i.e. preparation for the writing operation, is important.

In the all-cell initializing operation, it is necessary to cause initializing discharge using the scan electrodes as anodes and the sustain electrodes and data electrodes as cathodes. However, phosphors having smaller electron emission factors that are applied to the data electrodes may increase discharge delay in the initializing discharge using the data electrodes as cathodes, thus causing unstable initializing discharge in some cases.

Additionally, considerations have recently been given to increasing the partial pressure of xenon in the discharge gas filled into the panel to improve the luminous efficiency of the panel. However, an increase in the partial pressure of xenon destabilizes discharge, especially initializing discharge. This unstable discharge poses a problem of writing failure in the subsequent writing period that is caused by a narrower margin of the driving voltage in the wiring operation.

The present invention addresses these problems and aims to provide a method of driving a panel in which stabilization of initial discharge allows images to be displayed in excellent quality.

SUMMARY OF THE INVENTION

A method of driving a plasma display panel of the present invention, the plasma display panel including discharge cells, each formed at an intersection of a scan electrode and a sustain electrode, and a data electrode, the method comprising: dividing one field period into a plurality of sub-fields, each having an initializing period, writing period, and sustaining period; and in the initializing periods of the plurality of sub-fields, performing one of all-cell initializing operation and selective initializing operation, wherein, the all-cell initializing operation causes initializing discharge in all the discharge cells for displaying an image, and the selective initializing operation selectively causes initializing discharge only in the discharge cells subjected to sustaining discharge in the preceding sub-field; wherein each of the initializing periods for performing the all-cell initializing operation has a former half part and a latter half part of the initializing period, and an abnormal charge erasing part, in the former half part, application of an ascending ramp waveform voltage to the scan electrodes causes a first initializing discharge using the scan electrodes as anodes and the sustain electrodes and data electrodes as cathodes, in the latter half part, application of a descending ramp waveform voltage to the scan electrodes causes a second initializing discharge using the scan electrodes as the cathodes and the sustain electrodes and data electrodes as the anodes, and in the abnormal charge erasing part, application of a rectangular waveform voltage to the scan electrodes causes self-erasing discharge in the discharge cells having excessive wall charge accumulated therein.

DETAILED DESCRIPTION OF PREFERRED EMBODIMENTS

A method of driving a panel in accordance with an exemplary embodiment of the present invention is described hereinafter with reference to the accompanying drawings.

Exemplary Embodiment

Figure 1:
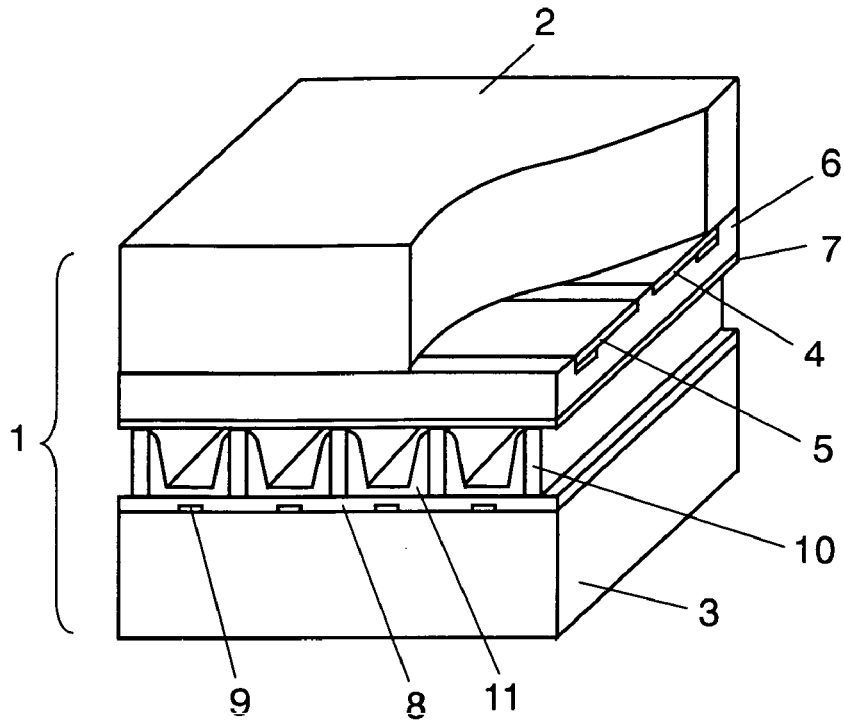
FIG. 1 is a perspective view illustrating an essential part of a panel for use in an exemplary embodiment of the present invention.

FIG. 1 is a perspective view illustrating an essential part of a panel for use in the exemplary embodiment of the present invention. Panel 1 is composed of front substrate 2 and rear substrate 3 that are made of glass and faced with each other so as to form a discharge space therebetween. On front substrate 2, a plurality of display electrodes, each formed of a pair of scan electrode 4 and sustain electrode 5, is formed in parallel with each other. Dielectric layer 6 is formed to cover scan electrodes 4 and sustain electrodes 5. On dielectric layer 6, protective layer 7 is formed. As protective layer 7, a material having a large secondary electron emission factor and high sputter resistance is desirable to cause stable discharge. In this exemplary embodiment, MgO thin film is used. On rear substrate 3, a plurality of data electrodes 9 covered with insulating layer 8 is provided. Barrier ribs 10 are provided on insulating layer 8 between data electrodes 9 in parallel therewith. Also, phosphor layers 11 are provided on the surface of insulating layer 8 and the side faces of barrier ribs 10. Front substrate 2 and rear substrate 3 are faced with each other in a direction in which scan electrodes 4 and sustain electrodes 5 intersect with data electrodes 9. In a discharge space formed therebetween, a mixed gas, e.g. neon-xenon, is filled as a discharge gas. In this exemplary embodiment, to improve the emission efficiency of the panel, the partial pressure of xenon in the discharge gas filled into the panel is increased to 10%.

Figure 2:
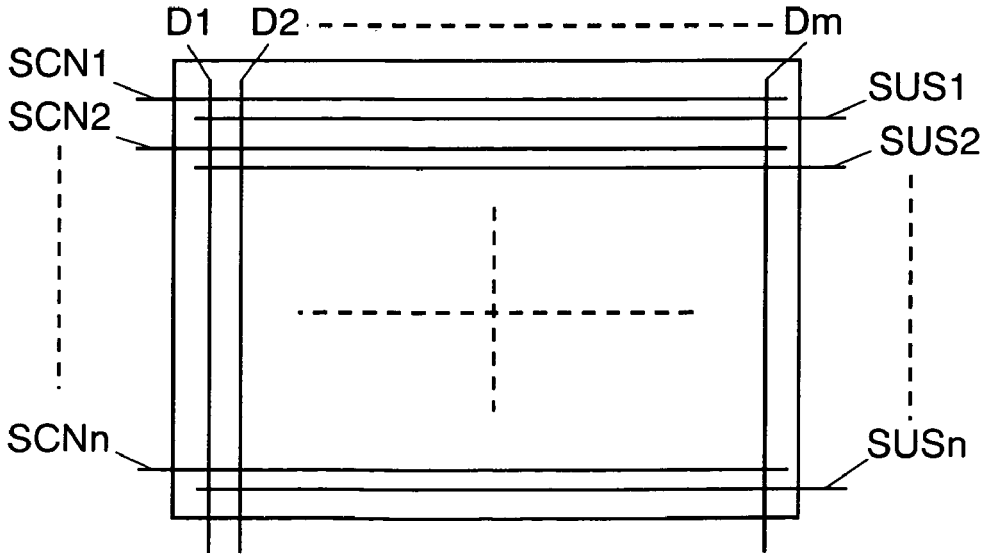
FIG. 2 is a diagram illustrating an array of electrodes of the panel.

FIG. 2 is a diagram showing an array of electrodes of the panel for use in the exemplary embodiment of the present invention. N scan electrodes SCN 1 to SCNn (scan electrodes 4 in FIG. 1) and n sustain electrodes SUS 1 to SUSn (sustain electrodes 5 in FIG. 1) are alternately disposed in a row direction. M data electrodes D1 to Dm (data electrodes 9 in FIG. 1) are disposed in a column direction. A discharge cell is formed at a portion in which a pair of scan electrode SCNi and sustain electrode SUSi (i=1 to n) intersect with one data electrode Dj (j=1 to m). Thus, m×n discharge cells are formed in the discharge space.

Figure 3:
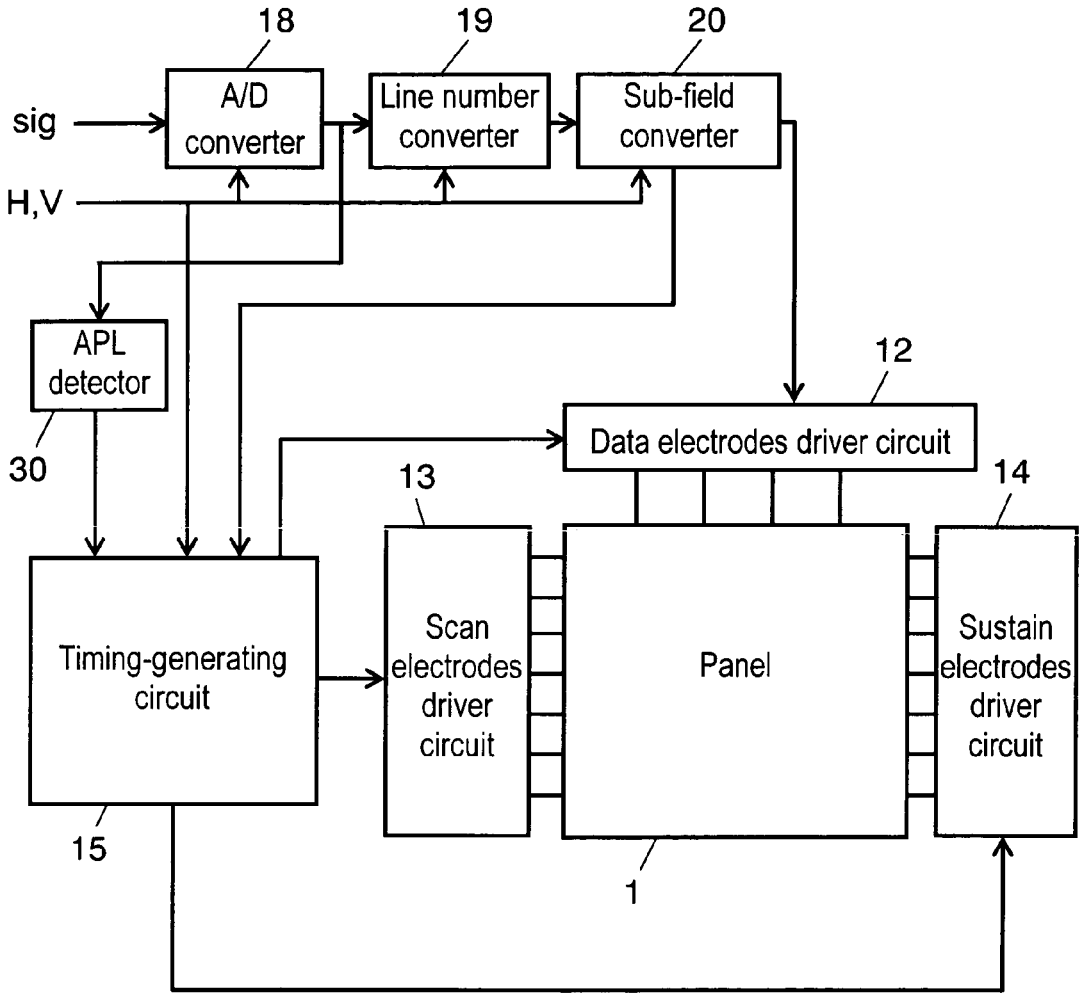
FIG. 3 is a block diagram showing a structure of a plasma display device using the method of driving a panel.

FIG. 3 is a block diagram showing a structure of a plasma display device using the method of driving a panel in accordance the exemplary embodiment. The plasma display panel device includes panel 1, data electrodes driver circuit 12, scan electrodes driver circuit 13, sustain electrodes driver circuit 14, timing-generating circuit 15, analog-to-digital (A/D) converter 18, line number converter 19, sub-field converter 20, average picture level (APL) detector 30, and power supply circuits (not shown).

With reference to FIG. 3, image signal sig is fed into A/D converter 18. Horizontal synchronizing signal H and vertical synchronizing signal V are fed into timing-generating circuit 15, A/D converter 18, line number converter 19, and sub-field converter 20. A/D converter 18 converts image signal sig into image data of digital signals, and feeds the image data into line number converter 19 and APL detector 30. APL detector 30 detects the average picture level of the image data. Line number converter 19 converts the image data into image data corresponding to the number of pixels of panel 1, and feeds the image data to sub-field converter 20. Sub-field converter 20 divides the image data of respective pixels into a plurality of bits corresponding to a plurality of sub-fields. The image data per sub-field is fed into data electrodes driver circuit 12. Data electrodes driver circuit 12 converts the image data per sub-field into signals corresponding to respective data electrodes D1 to Dm, and drives respective data electrodes D1 to Dm.

Timing-generating circuit 15 generates timing signals based on horizontal synchronizing signal H and vertical synchronizing signal V, and feeds the timing signals to scan electrodes driver circuit 13 and sustain electrodes driver circuit 14, respectively. Responsive to the timing signals, scan electrodes driver circuit 13 feeds driving waveforms to scan electrodes SCN1 to SCNn. Responsive to the timing signals, sustain electrodes driver circuit 14 feeds driving waveforms to sustain electrodes SUS1 to SUSn. At this time, timing-generating circuit 15 controls the driving waveforms, according to an APL supplied from APL detector 30. Specifically, as described later, according to the APL, timing-generating circuit 15 determines to perform one of all-cell initializing operation and selective initializing operation in each of the sub-fields comprising one field, and controls the number of the all-cell initializing operations in one field.

Next, driving waveforms for driving the panel and their operation are described. In the exemplary embodiment, one field is divided into 10 sub-fields (from a first SF to 10-th SF), and each of the sub-fields has a brightness weight of 1, 2, 3, 6, 11, 18, 30, 44, 60, or 80. In this manner, one field is structured so that the later sub-filed has a larger brightness weight.

Figure 4:
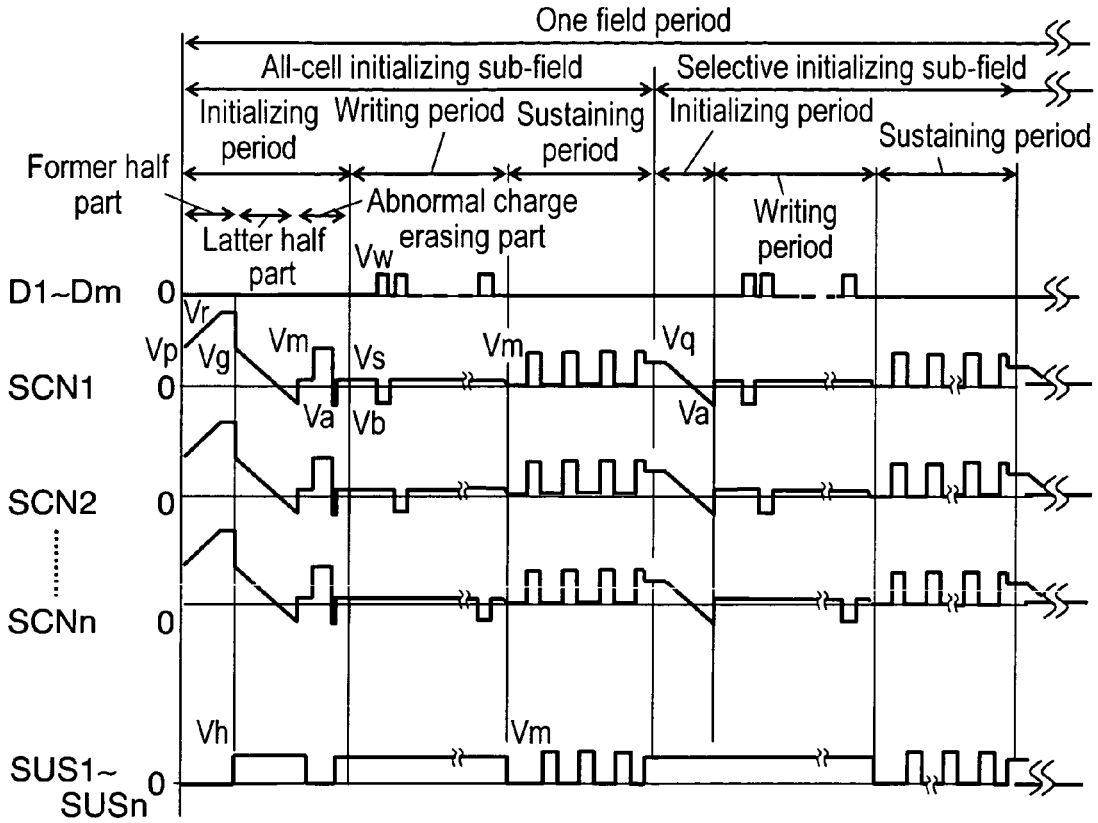
FIG. 4 is a diagram showing driving waveforms applied to the respective electrodes of the panel.

FIG. 4 is a diagram showing driving waveforms applied to respective electrodes of the panel used in the exemplary embodiment of the present invention. The diagram shows driving waveforms applied to a sub-field having an initializing period for performing all-cell initializing operation (hereinafter abbreviated as "all-cell initializing sub-field") and a sub-field having an initializing period for performing selective initializing operation (hereinafter abbreviated as "selective initializing sub-field"). In FIG. 4, for simple description, the first sub-field is shown as an all-cell initializing sub-field, and the second sub-field is shown as a selective initializing sub-field.

First, the driving waveforms in the all-cell initializing sub-field and their operation are described. In the description, the all-cell initializing period is divided into three periods, i.e. a former half part, a latter half part, and an abnormal charge erasing part, as follows.

In the former half part of the initializing period, while sustain electrodes SUS1 to SUSn and data electrodes D1 to Dm are kept at 0 (V), and an ascending ramp waveform voltage gradually increasing from voltage Vp (V) not higher than a discharge-starting voltage to voltage Vr (V) exceeding the discharge-starting voltage is applied to scan electrodes SCN1 to SCNn. This operation causes weak initializing discharge using scan electrodes SCN1 to SCNn as anodes, and sustain electrodes SUS1 to SUSn and data electrodes D1 to Dm as cathodes. In this manner, a first weak initializing discharge occurs in all the discharge cells. Thus, negative wall voltage accumulates on scan electrodes SCN1 to SCNn and positive wall voltage accumulates on sustain electrodes SUS1 to SUSn and data electrodes D1 to Dm. Now, the wall voltage on electrodes indicates a voltage generated by wall electric charge that has accumulated on the dielectric layer or phosphor layers covering the electrodes.

In the latter half part of the initializing period, while sustain electrodes SUS1 to SUSn are kept at positive voltage Vh (V), a descending ramp waveform voltage gradually decreasing from voltage Vg (V) to voltage Va (V) is applied to scan electrodes SCN1 to SCNn. This operation causes a second weak initializing discharge using scan electrodes SCN1 to SCNn as cathodes, and sustain electrodes SUS1 to SUSn and data electrodes D1 to Dm as anodes, in all the discharge cells. Then, the wall voltage on scan electrodes SCN1 to SCNn and the wall voltage on sustain electrodes SUS1 to SUSn are weakened, and the wall voltage on data electrodes D1 to Dm are adjusted to a value appropriate for writing operation. In this manner, the initializing operation in the all-cell initializing sub-field is all-cell initializing operation for causing initializing discharge in all the discharge cells.

In the abnormal charge erasing part of the initializing period, sustain electrodes SUS1 to SUSn are reset to 0 (V) again. To scan electrodes SCN1 to SCNn, after positive voltage Vm (V) smaller than a discharge-starting voltage is applied for 5 to 20 μs, negative voltage Va (V) is applied for a short period up to 3 μs. During these periods, no discharge occurs in the discharge cells in which stable initializing discharge has been performed, and the wall voltage in the discharge cells is kept to the state in the latter half part of the initializing period. However, in the discharge cells having abnormal wall charge accumulated on scan electrode SCNi, application of voltage Vm (V) to scan electrodes SCN1 to SCNn causes the discharge cells to exceed the discharge-starting voltage and causes strong discharge in the discharge cells. Thus, the polarity of the wall voltage on scan electrode SCN1 is inverted. Then, application of positive narrow pulse voltage Va (V) to scan electrodes SCN1 to SCNn causes self-erasing discharge and erases the wall charge inside of the discharge cells.

In the subsequent writing period, scan electrodes SCN1 to SCNn are held at voltage Vs (V) once. Next, positive write pulse voltage Vw (V) is applied to data electrode Dk (k=1 to m) of a discharge cell to be lit in the first row among data electrodes D1 to Dm, and scan pulse voltage Vb (V) is applied to scan electrode SCN1 in the first row. At this time, the voltage at the intersection between data electrode Dk and scan electrode SCN1 is addition of the wall voltage on data electrode Dk and the wall voltage on scan electrode SCN1 to externally applied voltage (Vw-Vb) (V), thus exceeding the discharge-starting voltage. This causes writing discharge between data electrode Dk and scan electrode SCN1, and between sustain electrode SUS1 and scan electrode SCN1. Thus, positive wall voltage accumulates on scan electrode SCN1, negative wall voltage accumulates on sustain electrode SUS1, and negative wall voltage also accumulates on data electrode Dk in this discharge cell. In this manner, writing operation is performed in the discharge cells to be lit in the first row to accumulate wall voltage on the respective electrodes. On the other hand, the voltages at intersections of data electrodes to which positive write pulse voltage Vw (V) is not applied, and scan electrode SCN1 do not exceed the discharge-starting voltage. Thus, no writing discharge occurs in these cells. In the discharge cells that have discharged in the abnormal charge erasing part of the initializing period, the wall charge on the data electrodes is also erased and thus writing discharge does not occur. Such writing operation is sequentially performed on the cells in the second row to the n-th row, and the writing period is completed.

In the subsequent sustaining period, first, sustain electrodes SUS1 to SUSn are reset to 0V, and positive sustain pulse voltage Vm (V) is applied to scan electrodes SCN1 to SCNn. At this time, in the discharge cells in which writing discharge has occurred, the voltage across scan electrode SCNi and sustain electrode SUSi amounts to addition of the wall voltage on scan electrode SCNi and the wall voltage on sustain electrode SUSi to sustain pulse voltage Vm (V), thus exceeding the discharge-starting voltage. This causes sustaining discharge between scan electrode SCNi and sustain electrode SUSi. Thus, negative wall voltage accumulates on scan electrode SCNi, and positive wall voltage accumulates on sustain electrode SUSi. At this time, positive wall voltage also accumulates on data electrode Dk. In the discharge cells in which no writing discharge has occurred in the writing period, no sustaining discharge occurs, and the state of the wall voltage at the time of completion of the initializing period is maintained. Subsequently, scan electrodes SCN1 to SCNn are reset to 0V, and positive sustain pulse voltage Vm (V) is applied to sustain electrodes SUS1 to SUSn. In the discharge cells in which sustaining discharge has occurred, the voltage across sustain electrode SUSi and scan electrode SCNi exceeds the discharge-starting voltage. This causes sustaining discharge between sustain electrode SUSi and scan electrode SCNi again. Thus, negative wall voltage accumulates on sustain electrode SUSi, and positive wall voltage accumulates on scan electrode SCNi. Applying sustain pulses alternately across scan electrodes SN1 to SCNn and sustain electrodes SUS1 to SUSn in a similar manner can continue sustaining discharge in the discharge cells in which writing discharge has occurred in the writing period. At the end of the sustaining period, the wall voltage on scan electrodes SCN1 to SCNn and sustain electrodes SUS1 to SUSn are erased by applying a so-called narrow pulse across scan electrodes SCN1 to SCNn and sustain electrodes SUS1 to SUSn while leaving the positive wall voltage on data electrode Dk. Thus, the sustaining operation in the sustaining period is completed.

Next, the driving waveforms in the selective initializing sub-field and their operation are described.

In the initializing period, sustain electrodes SUS1 to SUSn are kept at voltage Vh (V), data electrodes D1 to Dm are kept at 0V, and a descending ramp waveform voltage gradually decreasing from voltage Vq (V) to voltage Va (V) is applied to scan electrodes SCN1 to SCNn. This operation causes weak initializing discharge in the discharge cells in which sustaining discharge has occurred in the sustaining period of the preceding sub-field. The wall voltage on scan electrode SCNi and the wall voltage on sustain electrode SUSi are weakened, and the wall voltage on data electrode Dk is adjusted to a value appropriate for writing operation. On the other hand, in the discharge cells in which writing discharge or sustaining discharge has not occurred in the preceding sub-field, no discharge occurs and the state of the wall charge at the time of completion of the initializing period in the preceding sub-field is maintained. Thus, the operation in the initializing period of the selective initializing sub-field is selective initializing operation in which initializing discharge occurs in the discharge cells subjected to sustaining discharge in the preceding sub-field.

The writing period and sustaining period are the same as those of the all-cell initializing sub-field. Thus, the description is omitted.

Now, a description is provided of the reason why an abnormal charge erasing part is provided in the all-cell initializing period. When an ascending ramp waveform voltage gradually increasing is applied to scan electrodes SCN1 to SCNn in the former half part of the initializing period, weak initializing discharge occurs using scan electrodes SCN1 to SCNn as anodes and sustain electrodes SUS1 to SUSn as cathodes under normal circumstances. However, a high partial pressure of xenon filled into the panel increases discharge delay. Especially, insufficient priming can cause large discharge delay, even when the surfaces of sustain electrodes SUS1 to SUSn are covered with protective layer 7 having a large secondary electron emission factor. In this case, the voltage of the cells largely exceeds the discharge-starting voltage when discharge occurs. For this reason, the discharge is not weak, and strong discharge occurs. Alternatively, strong discharge using data electrodes D1 to Dm as cathodes precedes primary discharge. Thus, excessive negative wall voltage accumulates on scan electrodes SCN1 to SCNn. This excessive wall voltage causes strong discharge again during application of a descending ramp waveform voltage to scan electrodes SCN1 to SCNn in the latter half part of the initializing period. Thus, excessive positive wall charge accumulates on scan electrodes SCN1 to SCNn.

In another case, weak writing discharge in the writing period of the sub-field preceding the all-cell initializing sub-field causes wall charge to accumulate on the scan electrodes, sustain electrodes, or data electrodes insufficiently. In discharge cells in which the insufficient wall voltage cannot cause sustaining discharge in the sustaining period, abnormal wall charge may remain. In another case, even when writing discharge is performed normally, a decrease in the wall charge accumulated on the scan electrodes, sustain electrodes, and data electrodes may leave abnormal wall charge similarly. Then, the discharge cells having abnormal wall charge perform sustaining discharge in the sustaining period.

For this reason, an initializing period for performing an all-cell initializing has an abnormal charge erasing part, to erase abnormal charge in the discharge cells having abnormal wall discharge accumulated on the scan electrodes and prevent the discharge cells from performing erroneous discharge.

Next, a description is provided of a structure of sub-fields in the method of driving a panel of this embodiment. As described above, in this embodiment, one field is divided into 10 sub-fields (a first to 10th SFs). In the description, each of the sub-fields has a brightness weight of 1, 2, 3, 6, 11, 18, 30, 44, 60 or 80. However, the number of sub-fields or the brightness weight of each sub-field is not limited to the above values.

Figure 5:
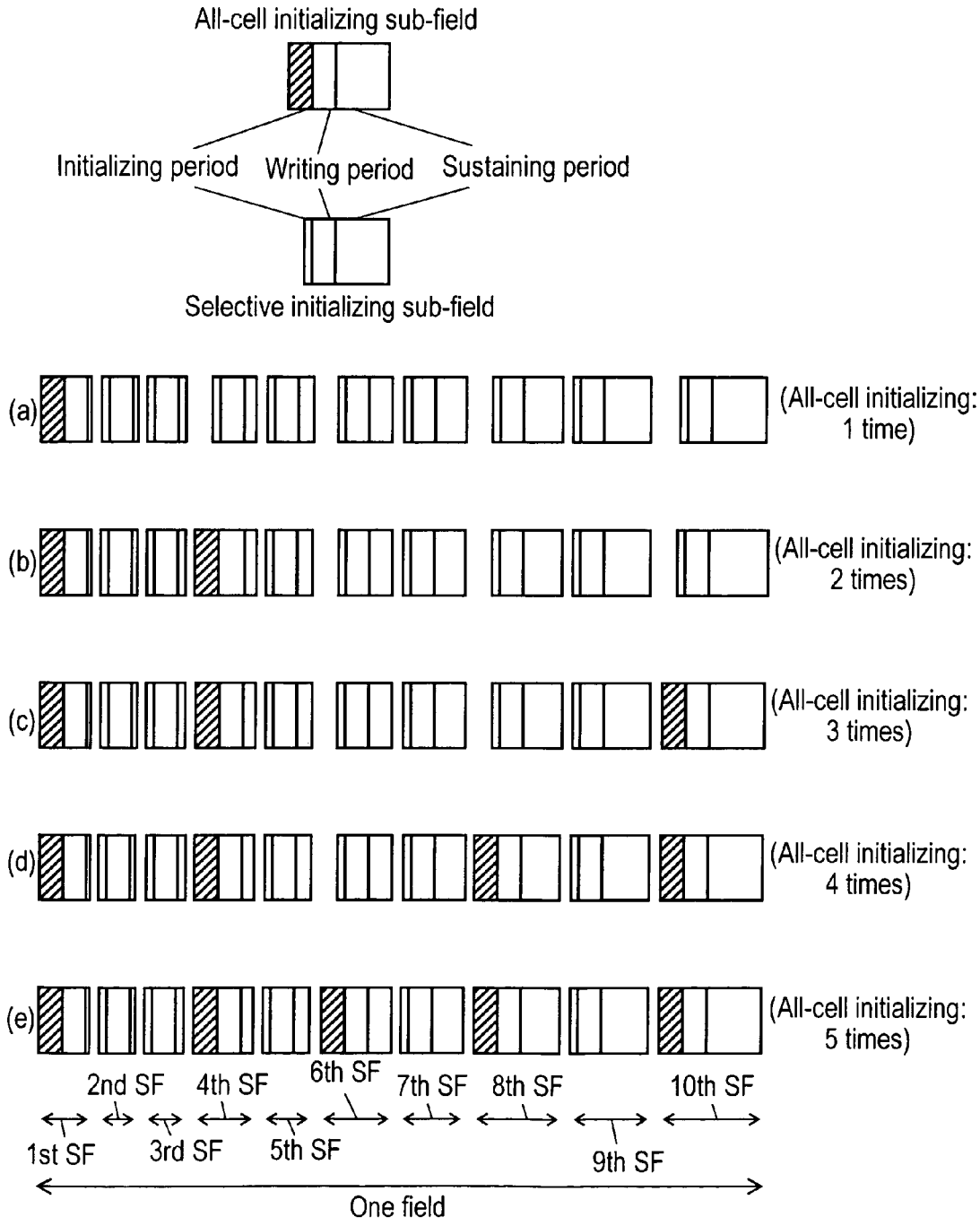
FIG. 5 is a diagram illustrating a structure of sub-fields in the method of driving a panel.

FIG. 5 is a diagram illustrating a structure of sub-fields (SF) of the method of driving a panel in accordance with the exemplary embodiment of the present invention. The sub-field structure is changed according to the APL of the signals of an image to be displayed. FIG. 5(*a*) shows a structure to be used for image signals having an APL ranging from 0 to 1.5%. In this SF structure, all-cell initializing operation is performed only in the initializing period of the first SF; selective initializing operation is performed in the initializing periods of the second to 10th SFs. FIG. 5(*b*) shows a structure to be used for image signals having an APL ranging from 1.5 to 5%. In this SF structure, all-cell initializing operation is performed in the initializing periods of the first and 4th SFs; selective initializing operation is performed in the initializing periods of the second, third, and fifth to 10th SFs. FIG. 5(*c*) shows a structure to be used for image signals having an APL ranging from 5 to 10%. In this SF structure, the first, fourth and 10th SFs are all-cell initializing SFs; the second, third, fifth to ninth SFs are selective initializing SFs. FIG. 5(*d*) shows a structure to be used for image signals having an APL ranging from 10 to 15%. In this SF structure, the first, fourth, eighth and 10th SFs are all-cell initializing SFs; the second, third, fifth to seventh, and ninth SFs are selective initializing SFs. FIG. 5(*e*) shows a structure to be used for image signals having an APL ranging from 15 to 100%. In this SF structure, the first, fourth, sixth, eighth and 10th SFs are all-cell initializing SFs; the second, third, fifth, seventh, and ninth SFs are selective initializing SFs. Table 1 shows relations between the above SF structures and APLs.

TABLE 1

| APL(%) | Number of all-cell initializing operations (times) | All-cell initializing SFs |
|---|---|---|
| 0 to 1.5 | 1 | 1 |
| 1.5 to 5 | 2 | 1, 4 |
| 5 to 10 | 3 | 1, 4, 10 |
| 10 to 15 | 4 | 1, 4, 8, 10 |
| 15 to 100 | 5 | 1, 4, 6, 8, 10 |

As described above, in this exemplary embodiment, because it is considered that there is no or a small area displaying a black picture when an image having a large APL is displayed, the number of all-cell initializing operations and thus priming are increased to stabilize discharge. In contrast, when an image having a low APL is displayed, it is considered that there is a large area displaying a black picture. Thus, the number of all-cell initializing operations and the black picture level are reduced to improve black display quality. Therefore, at a low APL, luminance in the area displaying a black picture is low, and an image having high contrast can be displayed even when the image has areas having high luminance.

The number of all-cell initializing operations per one field is determined so as to depend on the APL. In the all-cell initializing period, an abnormal charge erasing part is provided to prevent erroneous discharge developed by unstable initializing discharge. In the abnormal charge erasing part, application of a rectangular waveform voltage to the scan electrodes causes discharge cells having excessive wall voltage accumulated therein to perform self-erasing discharge.

In this exemplary embodiment, one field is composed of 10 SFs and the number of all-cell initializing operations is controlled to one to five times, as an example. However, the present invention is not limited to this example. Tables 2 and 3 show other examples.

TABLE 2

| APL(%) | Number of all-cell initializing operations (times) | All-cell initializing SFs |
|---|---|---|
| 0.0 to 1.5 | 1 | 1 |
| 1.5 to 5 | 2 | 1, 9 |
| 5 to 10 | 3 | 1, 4, 9 |
| 10 to 100 | 4 | 1, 4, 8, 10 |

TABLE 3

| APL(%) | Number of all-cell initializing operations (times) | All-cell initializing SFs |
|---|---|---|
| 0.0 to 1.5 | 1 | 1 |
| 1.5 to 5 | 2 | 1, 4 |
| 5 to 100 | 3 | 1, 4, 6 |

In Table 2, the number of all-cell initializing operations is controlled to one to four times, and the SFs in which all-cell initializing operation is performed are changed, as an example. In Table 3, the number of all-cell initializing operations is controlled to one to three times, and the SFs near the top of one field are initialized preferentially, as an example.

Figure 6A:
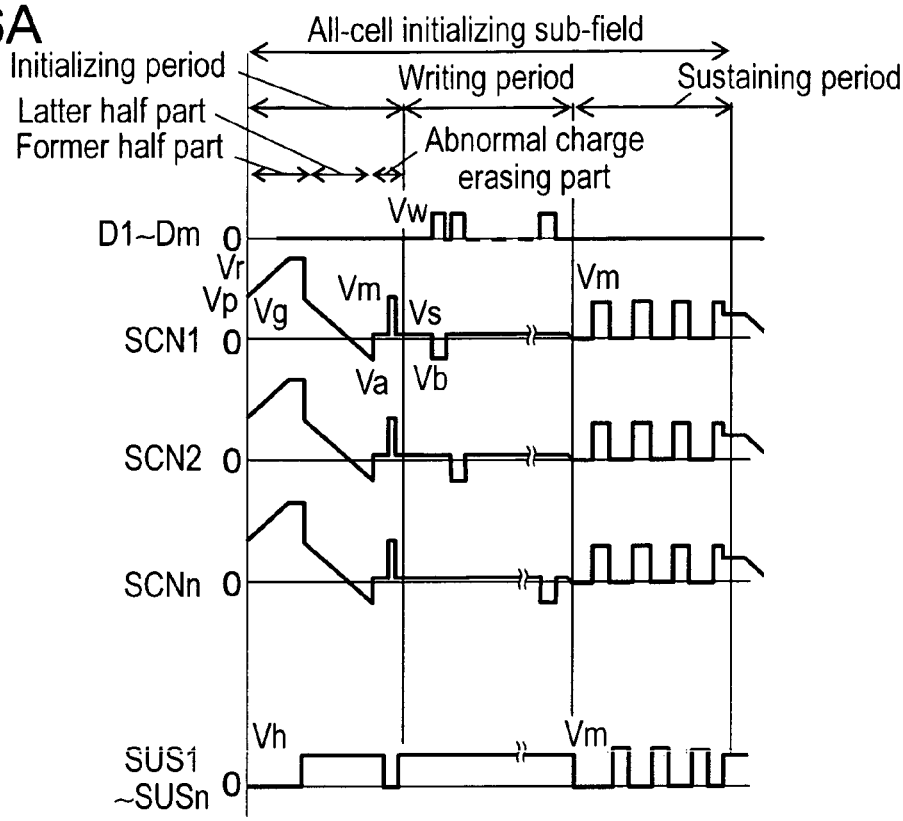
FIG. 6A is a diagram showing driving waveforms applied to the respective electrodes of the panel in another exemplary embodiment of the present invention.
Figure 6B:
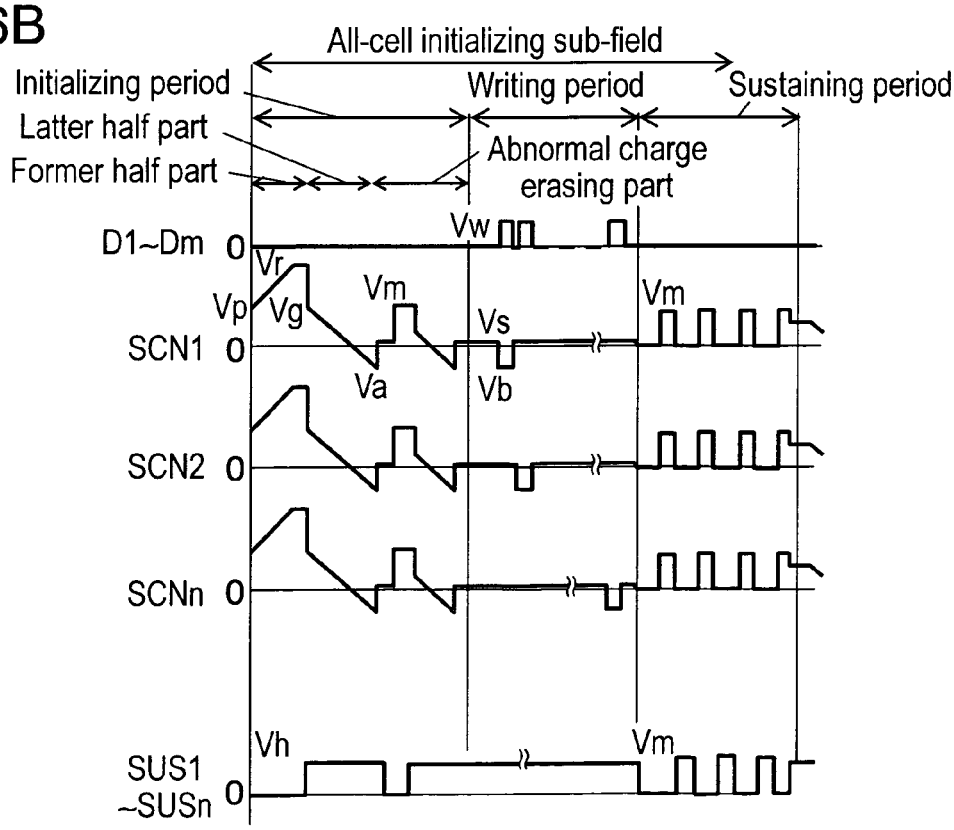
FIG. 6B is a diagram showing driving waveforms applied to the respective electrodes of the panel in still another exemplary embodiment of the present invention.

In the abnormal charge erasing part in the all-cell initializing period of this exemplary embodiment, after positive voltage Vm (V) less than the discharge-starting voltage is applied to scan electrodes SCN1 to SCNn for 5 to 20 μs, negative voltage Va (V) is applied for a short period up to 3 μs. However, the present invention is not limited to this example. FIGS. 6A and 6B are other driving voltage waveforms in the abnormal charge erasing part. The driving voltage waveform shown in FIG. 6A is a so-called narrow erasing pulse waveform with which positive voltage Vm (V) less than the discharge starting voltage is applied to scan electrodes SCN1 to SCNn for a short period up to 3 μs, to erase the wall charge. This method has an advantage of considerably reducing the time taken for the abnormal charge erasing part, although application of voltage for a short period of time slightly increases a chance that the discharge cells having abnormal wall voltage perform no discharge. With the driving voltage waveform shown in FIG. 6B, sustain electrodes SUS1 to SUSn are reset to 0 V and application of positive voltage Vm (V) less than the discharge-starting voltage to scan electrodes SCN1 to SCNn for approx. 5 μs causes discharge in the discharge cells having abnormal wall voltage accumulated therein, and inverts the polarity of the wall voltage therein. Next, sustain electrodes SUS1 to SUSn are kept to Vh (V), and a descending ramp waveform voltage is applied to scan electrodes SCN1 to SCNn to decrease the inverted wall voltage. Although this method has a disadvantage of increasing the time taken for the abnormal charge erasing part because it uses ramp waveform voltage, adjusting the wall charge on respective electrodes enables normal writing operation in the subsequent writing operation.

Further repeating the abnormal charge erasing part shown in FIG. 4, 6A, or 6B a plurality of times in the all-cell initializing period can securely erase the abnormal wall charge in the discharge cells having abnormal wall charge accumulated therein.

As described above, in the method of driving a panel of this exemplary embodiment, providing an abnormal charge erasing part for causing self-erasing discharge in the discharge cells having excessive wall voltage accumulated therein allows images to be displayed in excellent quality, even with a panel having a higher partial pressure of xenon in the discharge gas filled into the panel.

Thus, the present invention can provide a method of driving a plasma display panel in which stabilization of initializing discharge allows images to be displayed in excellent quality.

INDUSTRIAL APPLICABILITY

In the method of driving a panel of this invention, stabilization of initializing discharge allows images to be displayed in excellent quality. The present invention is useful for an image display device or the like, using a plasma display panel.

The invention claimed is:

1. A method of driving a plasma display panel, the plasma display panel including discharge cells, each discharge cell formed at an intersection of a scan electrode and a sustain electrode, and a data electrode, the method comprising:

dividing one field period into a plurality of sub-fields, each sub-field having an initializing period, followed by a writing period, and followed by a sustaining period; and in the initializing periods of the plurality of sub-fields, selecting between all-cell initializing operation and selective initializing operation based on an average picture level (APL) of signals of an image to be displayed, wherein, the all-cell initializing operation causes initializing discharge in all the discharge cells for displaying an image, and the selective initializing operation selectively causes initializing discharge only in the discharge cells subjected to sustaining discharge in the preceding sub-field, wherein a sub-field in which the all-cell initializing operation is selected immediately precedes or immediately follows a sub-field in which the selective initializing operation is selected;

wherein, each of the initializing periods for performing the all-cell initializing operation has a former half part, followed by a latter half part, and an abnormal charge erasing part, in the former half part, application of an ascending ramp waveform voltage with a polarity to the scan electrodes causes a first initializing discharge using the scan electrodes as anodes and the sustain electrodes and data electrodes as cathodes, in the latter half part, application of a descending ramp waveform voltage which is ranging from a voltage with the same polarity as the voltage applied during the former half part of initialization period to a voltage reverse in polarity thereto, to the scan electrodes causes a second initializing discharge using the scan electrodes as the cathodes and the sustain electrodes and data electrodes as the anodes, and in an abnormal charge erasing part which is provided after the latter half part and before the writing period, applying a positive rectangular waveform voltage to the scan electrodes for a predetermined period of time and then applying a negative rectangular waveform voltage for a shorter period than the predetermined period of time; and wherein, in the initializing periods for performing the selective initializing operation, only a descending ramp waveform voltage is applied to the scan electrodes, using the scan electrodes as cathodes and the sustain electrodes and data electrodes as anodes while the sustain electrodes are maintained at a positive voltage, wherein the sustain electrodes are maintained at zero voltage during the former half part and the abnormal charge erasing part, and the sustain electrodes are maintained at the positive voltage during the latter half part.

2. The method of driving a plasma display panel according to claim 1, wherein a number of times of all-cell initializing period in the one field period is controlled by determining either the all-cell initializing operation or the selective initializing operation according to an APL.

3. The method of driving a plasma display panel according to claim 1, wherein the predetermined period of time in which the positive rectangular waveform voltage is applied is greater than or equal to 5 μs, and the period, in which the negative rectangular waveform is applied, shorter than the predetermined period of time is less than or equal to 3 μs.

* * * * *